US007324937B2

(12) United States Patent
Thyssen et al.

(10) Patent No.: US 7,324,937 B2
(45) Date of Patent: Jan. 29, 2008

(54) METHOD FOR PACKET LOSS AND/OR FRAME ERASURE CONCEALMENT IN A VOICE COMMUNICATION SYSTEM

(75) Inventors: Jes Thyssen, Laguna Niguel, CA (US); Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 82 days.

(21) Appl. No.: 10/968,300

(22) Filed: Oct. 20, 2004

(65) Prior Publication Data

US 2005/0091048 A1 Apr. 28, 2005

Related U.S. Application Data

(60) Provisional application No. 60/515,712, filed on Oct. 31, 2003, provisional application No. 60/513,742, filed on Oct. 24, 2003.

(51) Int. Cl.
*G10L 19/08* (2006.01)

(52) U.S. Cl. ..... 704/219; 704/500

(58) Field of Classification Search ..... None
See application file for complete search history.

(56) References Cited

U.S. PATENT DOCUMENTS 5,615,298 A * 3/1997 Chen ..... 704/228
5,884,010 A * 3/1999 Chen et al. ..... 704/228

FOREIGN PATENT DOCUMENTS

EP 1 288 916 A2 9/1995
EP 0 673 017 A2 3/2003

OTHER PUBLICATIONS

European Search issued in European Appl. No. 04025313.0 on Feb. 21, 2005, 3 pages.
Watkins et al., "Improving 16 kb/s G.728 LD-Celp Speech Coder For Frame Erasure Channels," 1995 International Conference On Acoustics Speech, and Signal Processing, Detroit, MI, May 9-12, 1995, vol. 1, pp. 241-244.

* cited by examiner

*Primary Examiner*—Abul K. Azad
(74) *Attorney, Agent, or Firm*—Sterne, Kessler, Goldstein & Fox P.L.L.C.

(57) ABSTRACT

A method for performing packet loss concealment (PLC) and/or frame erasure concealment (FEC) in a speech decoder of a voice communication system. In accordance with the method, if a segment of an encoded speech signal is determined to be bad, an excitation signal is derived by scaling a random sequence of samples, and long-term and short-term predictive parameters are derived based on parameters associated with a previously-decoded segment. The excitation signal is then filtered by a long-term synthesis filter and a short-term synthesis filter under the control of the respective long-term and short-term predictive parameters. If the number of consecutively-received bad segments exceeds a predetermined threshold, the decoded speech signal is gradually reduced.

41 Claims, 4 Drawing Sheets

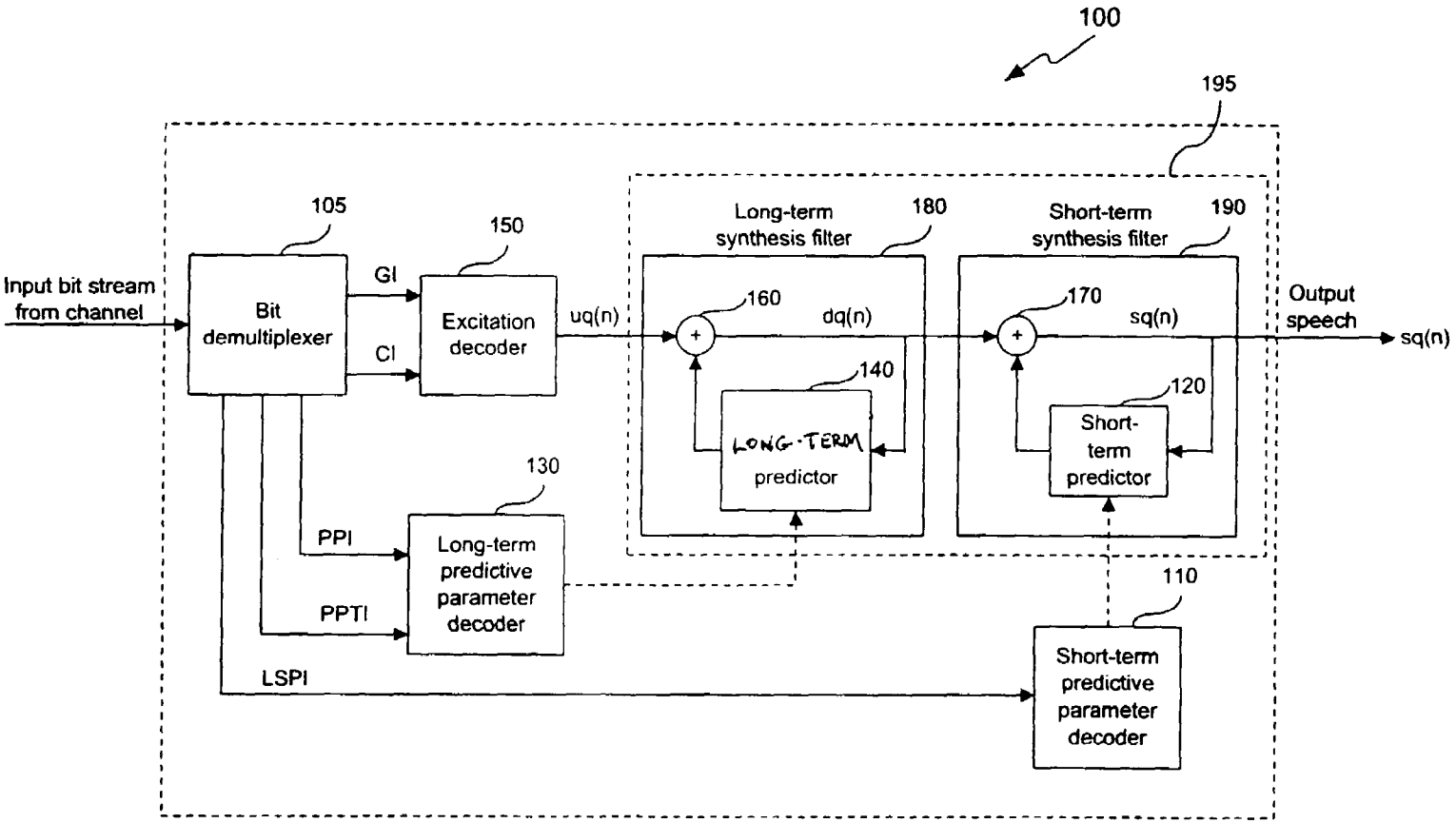
FIG. 1
(conventional)

METHOD FOR PACKET LOSS AND/OR FRAME ERASURE CONCEALMENT IN A VOICE COMMUNICATION SYSTEM

CROSS-REFERENCE TO RELATED APPLICATIONS

This application claims the benefit of U.S. provisional patent application No. 60/513,742 entitled "Packet-Loss Concealment Techniques", which was filed on Oct. 24, 2003, and U.S. provisional patent application No. 60/515,712 entitled "Systems and Methods for an Improved Speech Codec", which was filed Oct. 31, 2003. Both of these applications are hereby incorporated by reference as if fully set forth herein.

BACKGROUND OF THE INVENTION

1. Field of the Invention

The present invention relates generally to techniques for decoding an encoded speech signal in a voice communication system, and more particularly, to techniques for decoding an encoded speech signal in a voice communication system wherein one or more segments of the encoded speech signal have been lost, erased or corrupted.

2. Background

In speech coding, sometimes called voice compression, a coder encodes an input speech or audio signal into a digital bit stream for transmission. A decoder decodes the bit stream into an output signal. The combination of the coder and the decoder is called a codec. The speech signal is often partitioned into frames for encoding, and the bits representing the encoded speech then has a natural partitioning with a frame size corresponding to the frame of speech. For transmission purposes, any number of frames of bits can be packed into a super frame, which is also called a packet.

Where the transmission medium is a packet-switched network, so-called packet loss can cause frames of transmitted bits to be lost. When packet loss occurs, the decoder cannot perform normal decoding operations since there are no bits to decode in the lost frame. To rectify this, the decoder needs to perform packet loss concealment (PLC) operations to try to conceal the quality-degrading effects of the packet loss. A similar problem can occur in a wireless network, where transmitted frames may be lost, erased, or corrupted. This condition is called frame erasure in wireless communications, and the operations performed at the decoder to rectify it are referred to as frame erasure concealment (FEC).

What is desired is a method for performing PLC and/or FEC in a voice communication system that has low complexity but nevertheless provides regenerated speech of missing segments with as little distortion and as few perceptually disturbing artifacts as possible.

BRIEF SUMMARY OF THE INVENTION

The present invention provides a method for performing packet loss concealment (PLC) and/or frame erasure concealment (FEC) in a voice communication system. The method improves the quality of a speech signal that has been subject to packet loss and/or frame erasure during transmission from a speech coder to a speech decoder.

In accordance with an embodiment of the present invention, when a segment of an encoded speech signal is determined to be bad, an excitation signal is derived by scaling a random sequence of samples, and long-term and short-term predictive parameters are derived based on parameters associated with a previously-decoded segment. The excitation signal is then filtered by a long-term synthesis filter and a short-term synthesis filter under the control of the respective long-term and short-term predictive parameters.

In a particular embodiment of the present invention, a measure of periodicity of the speech signal is used to control the scaling of the random sequence. For example, a smoothed measure of periodicity may be used. This technique facilitates "clean" regeneration of voiced speech, yet maintains a smooth energy contour of unvoiced speech and background noise.

In a still further embodiment of the present invention, if the number of consecutively-received bad segments exceeds a predetermined threshold, the decoded speech signal is gradually reduced. This may be achieved by scaling down the random sequence and also scaling down filter coefficients associated with a long-term synthesis filter. This technique achieves two goals: (1) it gradually mutes the regenerated signal during extended missing segments, and (2) it gradually reduces the periodicity of the output speech during extended missing segments, thus making the output speech sound less buzzy.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the art to make and use the invention.

FIG. 1 is a block diagram of a conventional predictive decoder.

Figure 2:
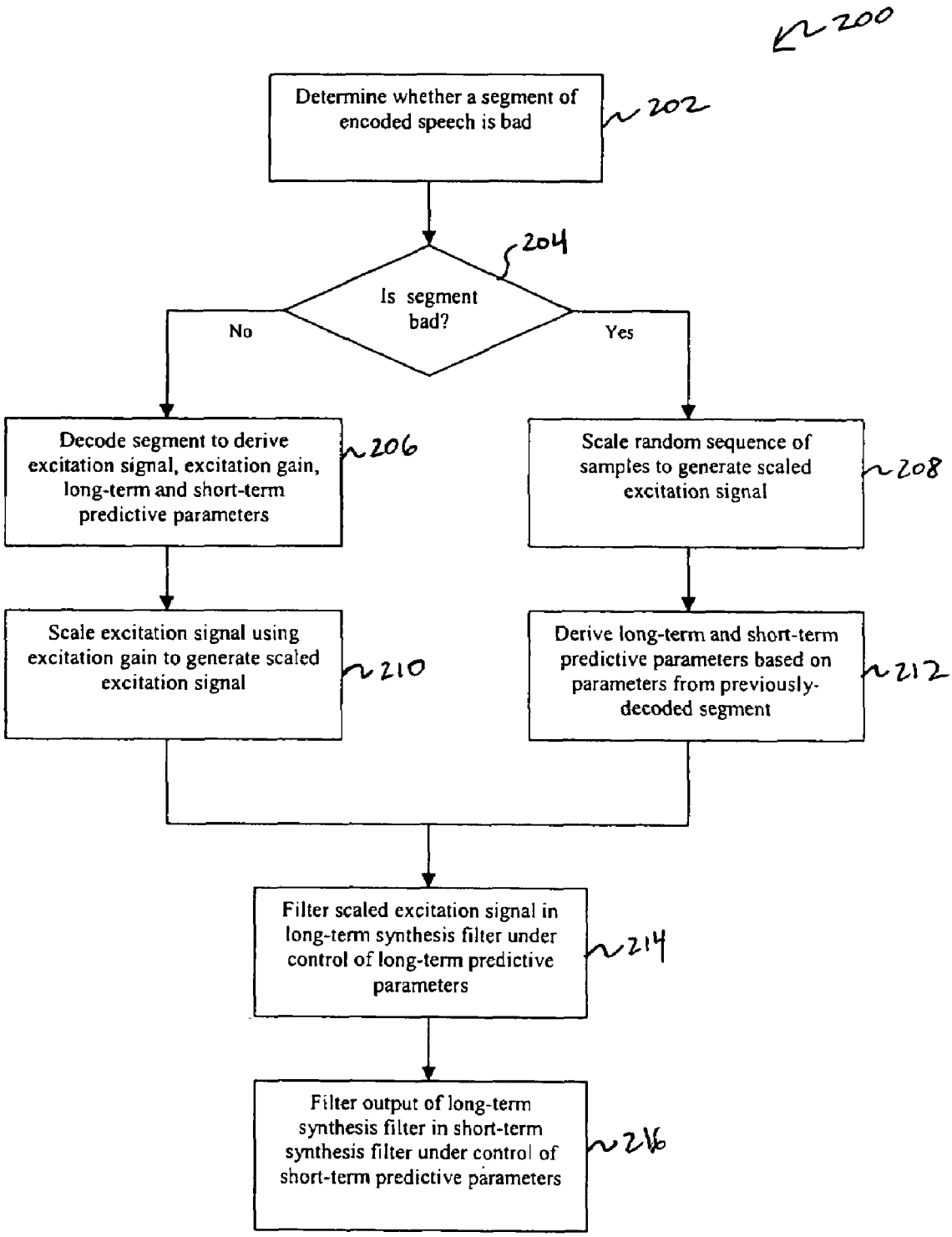
FIG. 2 is a flowchart of a method for performing PLC and/or FEC in accordance with an embodiment of the present invention.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

A. Example Conventional Predictive Decoder

A method for performing packet loss concealment (PLC) and/or frame erasure concealment (FEC) in accordance with the present invention is particularly suited for predictive speech codecs including, but not limited to, Adaptive Predictive Coding (APC), Multi-Pulse Linear Predictive Coding (MPLPC), Code Excited Linear Prediction (CELP), and Noise Feedback Coding (NFC).

FIG. 1 is a block diagram of a conventional predictive decoder 100, which is described herein to provide a better understanding of the present invention. Decoder 100 can be used to describe the decoders of APC, MPLPC, CELP and NFC speech codecs. The more sophisticated versions of the codecs associated with predictive decoders typically use a short-term predictor to exploit the redundancy among adjacent speech samples and a long-term predictor to exploit the redundancy between distant samples due to pitch periodicity of, for example, voiced speech.

The main information transmitted by these codecs is a quantized version of a prediction residual signal after short-term and long-term prediction. This quantized residual signal is often called the excitation signal because it is used in the decoder to excite a long-term synthesis filter and a short-term synthesis filter to produce the output decoded speech. In addition to the excitation signal, several other speech parameters are also transmitted as side information on a segment-by-segment basis.

A segment may correspond to a frame or sub-frame of sampled speech. An exemplary length for a frame (called frame size) can be in the range of 5 ms to 40 ms, with 10 ms and 20 ms as the two most popular frame sizes for speech codecs. Each frame typically contains a predetermined number of equal-length sub-frames. The side information of these predictive codecs typically includes spectral envelope information in the form of short-term predictive parameters, long-term predictive parameters such as pitch period and pitch predictor taps, and excitation gain.

As shown in FIG. 1, decoder 100 includes a bit demultiplexer 105, a short-term predictive parameter decoder 110, a long-term predictive parameter decoder 130, an excitation decoder 150, a long-term synthesis filter 180 and a short-term synthesis filter 190.

Bit demultiplexer 105 separates the bits in each received frame of bits into codes for the excitation signal, the short-term predictive parameters, the long-term predictive parameters, and the excitation gain.

The short-term predictive parameters, often referred to as the linear predictive coding (LPC) parameters, are usually transmitted once a frame. There are many alternative parameter sets that can be used to represent the same spectral envelope information. The most popular of these is the line-spectrum pair (LSP) parameters, sometimes called line-spectrum frequency (LSF) parameters. In FIG. 1, LSPI represents the transmitted quantizer codebook index representing the LSP parameters in each frame. Short-term predictive parameter decoder 110 decodes LSPI into an LSP parameter set and then converts the LSP parameters to the coefficients for the short-term predictor. These short term predictor coefficients are then used to control the coefficient update of a short-term predictor 120 within short-term synthesis filter 190.

Pitch period is defined as the time period at which a voiced speech waveform appears to be repeating itself periodically at a given moment. It is usually measured in terms of a number of samples, is transmitted once a sub-frame, and is used as the bulk delay in long-term predictors. Pitch taps are the coefficients of the long-term predictor. The bit demultiplexer 105 also separates out the pitch period index (PPI) and the pitch predictor tap index (PPTI) from the received bit stream. A long-term predictive parameter decoder 130 decodes PPI into the pitch period, and decodes the PPTI into the pitch predictor taps. The decoded pitch period and pitch predictor taps are then used to control the parameter update of a long-term predictor 140 within long-term synthesis filter 180.

In its simplest form, long-term predictor 140 is just a finite impulse response (FIR) filter, typically first order or third order, with a bulk delay equal to the pitch period. However, in some variations of CELP and MPLPC codecs, long-term predictor 140 has been generalized to an adaptive codebook, with the only difference being that when the pitch period is smaller than the sub-frame, some periodic repetition operations are performed. Thus, long-term predictor 140 may represent, but is not limited to, a straightforward FIR filter or an adaptive codebook.

Bit demultiplexer 105 also separates out a gain index GI and an excitation index CI from the input bit stream. Excitation decoder 150 decodes the CI into an unscaled excitation signal, and also decodes the GI into the excitation gain. Then, it uses the excitation gain to scale the unscaled excitation signal to derive a scaled excitation gain signal uq(n), which can be considered a quantized version of the long-term prediction residual. An adder 160 combines the output of long-term predictor 140 with the scaled excitation gain signal uq(n) to obtain a quantized version of a short-term prediction residual signal dq(n). An adder 170 combines the output of short-term predictor 120 to dq(n) to obtain an output decoded speech signal sq(n).

A feedback loop is formed by long-term predictor 140 and adder 160 and can be regarded as a single filter, called a long-term synthesis filter 180. Similarly, another feedback loop is formed by short-term predictor 120 and adder 170. This other feedback loop can be considered a single filter called a short-term synthesis filter 190. Long-term synthesis filter 180 and short-term synthesis filter 190 combine to form a synthesis filter module 195.

In summary, the conventional predictive coder 100 depicted in FIG. 1 decodes the parameters of short-term predictor 120 and long-term predictor 140, the excitation gain and the unscaled excitation signal. It then scales the unscaled excitation signal with the excitation gain, and passes the resulting scaled excitation signal uq(n) through long-term synthesis filter 180 and short-term synthesis filter 190 to derive the output decoded speech signal sq(n).

B. Speech Decoder Implementing Packet Loss Concealment and/or Frame Erasure Concealment in Accordance with an Embodiment of the Present Invention The present invention provides a method for improving the quality of decoded speech subject to packet loss or frame erasure. The method of the present invention permits a speech decoder to regenerate speech during periods where no information is received. The objective of the method is to adaptively regenerate speech of missing segments with as little distortion and as few perceptually disturbing artifacts as possible.

In an embodiment, the invention is implemented in a predictive speech decoder, such as that described above in reference to FIG. 1, in which a long-term excitation is used to excite a series of a long-term synthesis filter and a short-term synthesis filter. With the use of the notation of the z-transform, speech synthesis based on such a series is expressed as $$X(z)=F_{st}(z)\cdot F_{lt}(z)\cdot E(z)$$

where X(z) is the z-transform of the synthesized speech (for example, the decoded speech), E(z) is the z-transform of the long-term excitation, and $F_{st}(z)$ and $F_{lt}(z)$ are the z-transforms of the short-term and long-term synthesis filters, respectively. In speech coding, the short-term synthesis filter is commonly given by $$F_{st}(z) = \frac{1}{A(z)}$$

where A(z) is the short-term prediction error filter given by $$A(z) = \sum_{i=0}^{K} a_i \cdot z^{-i}.$$

Typically, a short-term prediction order, K, in the range of 8 to 20 is used. The long-term synthesis filter is commonly given by $$F_{lt}(z) = \frac{1}{B(z)}$$

where B(z) is the long-term prediction error filter, or pitch prediction error filter. Typically a first order long-term prediction error filter, $$B(z)=b\cdot z^{-L}$$

or a third order long-term prediction error filter, $$B(z)=b_0\cdot z^{-L-1}+b_1\cdot z^{-L}+b_2\cdot z^{-+1}$$

is used. The excitation of a series of long-term and short-term synthesis filters with the long-term excitation typically involves passing the long-term excitation through the long-term synthesis filter to obtain the short-term excitation, which is subsequently passed through the short-term synthesis filter to obtain the synthesized speech (for example, the decoded speech). The parameter L represents the pitch period.

In theory, the long-term prediction residual signal, which is obtained by passing a speech signal through its short-term prediction error filter followed by its long-term prediction error filter, is close to a random signal. Furthermore, since the governing physiological process of many speech sounds evolve relatively slowly, the parameters of the above-described synthesis model also evolve relatively slowly. Typically, the long-term prediction residual is the optimal long-term excitation. Due to quantization at the speech encoder for transmission purposes, the excitation signal is not identical to the long-term residual, but its fundamental properties are similar and it is approximately random. Hence, in accordance with an embodiment of the present invention, during a missing segment of speech (for example, where packet loss or frame erasure has occurred), the parameter values of the synthesis model can be based on the values of the synthesis model of the previous speech (prior to the missing segment), and a random sequence of samples scaled to a proper level can be used as long-term excitation. Based on this principle, when a packet or frame is not received in a speech decoder, an embodiment of the present invention conceals the packet loss or frame erasure by exciting the cascaded long-term and short-term synthesis filters with a random sequence of samples scaled to a proper level.

FIG. 2 illustrates a flowchart of an exemplary method for performing PLC or FEC in a speech decoder in accordance with the foregoing principles. As shown in FIG. 2, the method begins at step 202 in which a determination is made as to whether a segment of encoded speech is bad. A segment is considered bad if it is lost, erased, or otherwise so corrupted so as to be not useful for purposes of speech decoding. As noted above, a bad segment may result from packet loss or frame erasure. Depending on the outcome of the determination, processing branches as shown at step 204. Typically, a flag indicating whether the segment is good or bad is provided as input to the speech decoder/PLC or FEC from a higher system level. In the case of wireless systems the determination may be made by a channel decoder. In the case of VoIP systems, the determination may be made by a jitter buffer according to arrival statistics of incoming packets.

If the speech segment is determined to be good, then the segment is decoded to derive an excitation signal, excitation gain, and short-term and long-term predictive parameters as shown at step 206. At step 210, the excitation signal is scaled using the excitation gain to generate a scaled excitation signal. These are operations that are carried out in many conventional predictive speech decoders, as described above with respect to conventional decoder 100 of FIG. 1.

However, if the speech segment is bad, then a different technique is used to obtain the scaled excitation signal, short-term and long-term predictive parameters. In particular, a random sequence of samples is scaled to generate the scaled excitation signal, as shown at step 208. Then, at step 212 the long-term and short-term predictive parameters are derived based on long-term and short-term predictive parameters associated with a previously-decoded speech segment. For example, in an embodiment, the long-term predictive parameters (e.g., the pitch period and pitch taps) and short-term predictive parameters of the previously-decoded speech segment are directly substituted for the long-term and short-term predictive parameters of the current segment.

Once the scaled excitation signal, short-term and long-term predictive parameters have been obtained, the scaled excitation signal is filtered in the long-term synthesis filter under the control of the long-term predictive parameters as shown at step 214. The output of the long-term synthesis filter, which may be termed the short-term excitation, is then filtered in the short-term synthesis filter under the control of the short-term predictive parameters as indicated at step 216. The output of the short-term synthesis filter is synthesized speech, which may be for example the decoded speech.

1. Generation of Scaled Long-Term Excitation Signal

A specific technique for scaling the random sequence to generate a scaled excitation signal, as mentioned above in reference to step 208, will now be described. In an embodiment of the present invention, when a periodic segment, such as voiced speech, is lost or otherwise determined to be bad, the energy of the random sequence is advantageously decreased as compared to the energy of the long-term excitation of a previously-received segment (also referred to as previous long-term excitation). However, when a non-periodic segment, such as unvoiced speech or background noise, is lost or otherwise determined to be bad, the energy of the random sequence is maintained approximately to that of the previous long-term excitation. This technique facilitates "clean" regeneration of voiced speech yet maintains a smooth energy contour of unvoiced speech and background noise. Thus, choppiness is avoided for noise-like signals such as unvoiced speech and background noise, and voice speech is "clean". The foregoing requires adaptation of the scaling of the random sequence beyond simply equalizing the energy of past long-term excitation.

In particular, an embodiment of the present invention uses a measure of periodicity to control the scaling of the random sequence. For bad segments of estimated low periodicity (such as noise-like signals), the scaling goes towards equalizing the energy of previous long-term excitation, while for bad segments of high periodicity (such as voiced speech), the scaling goes below equalizing the energy of previous long-term excitation. One estimate of periodicity that may be used in accordance with an embodiment of the present invention involves simply using a periodicity measure corresponding to the last non-regenerated segment, which may be termed the instantaneous periodicity measure. However, an alternate embodiment of the present invention advantageously uses a smoothed periodicity measure, which can be obtained by smoothing or low pass filtering the instantaneous periodicity measure. For example, if the measure of instantaneous periodicity at time k is given by c(k), the smoothed periodicity measure can be estimated as $$c_s(k)=\alpha\cdot c_s(k-1)+(1-\alpha)\cdot c(k),$$

where $\alpha$ is a predetermined factor that controls the degree of smoothing. The smoothing will reduce fluctuations in the instantaneous periodicity measure and facilitate a more accurate control of the scaling of the random sequence.

In one embodiment of the present invention, scaling of the random sequence includes calculating a scaling factor and applying the scaling factor to scale the random sequence relative to a level of previous long-term excitation. The level of previous long-term excitation may be measured in terms of signal energy, or by any other appropriate method. For example, the level of previous long-term excitation may also be measured in terms of average signal amplitude. The scaling factor is calculated in such a way that the value of the scaling factor is increased towards an upper limit with decreasing periodicity and decreased towards a lower limit with increasing periodicity. As a result of the application of the scaling factor, the level of the random sequence will approach the level of previous long-term excitation for decreasing periodicity and will decrease as compared to the level of previous long-term excitation for increasing periodicity.

A more specific example of the foregoing scaling technique will now be described. In an embodiment, the random sequence is scaled according to $$uq(n) = g_{plc}\cdot\sqrt{\frac{E_{m-1}}{\sum_{n=1}^{FRSZ}[r(n)]^2}}\cdot r(n),\ n = 1, 2, \ldots\ FRSZ,$$

where r(n), n=1, 2, . . . FRSZ, is a random sequence of samples from one to the segment size (e.g., the frame size), $E_{m-1}$ is in principle the energy of the long-term synthesis filter excitation of the previously-decoded segment, and $g_{plc}$ is a scaling factor, the calculation of which will be detailed below. During good segments, an estimate of periodicity is updated as $$\mathrm{per}_m=0.5\ \mathrm{per}_{m-1}+0.5\ bs$$

where $\mathrm{per}_m$ is the updated periodicity estimate, $\mathrm{per}_{m-1}$ is the periodicity estimate for the previously-decoded segment, and bs is the sum of the pitch taps for the long-term synthesis filter (e.g., in an embodiment there may be three pitch taps) clipped at a lower threshold of zero and an upper threshold of one. During bad segments, the periodicity estimate is maintained: $\mathrm{per}_m=\mathrm{per}_{m-1}$. Based on the periodicity, the scaling factor is calculated in accordance with a monotonic decreasing function $$g_{plc}=-2\ \mathrm{per}_{m-1}+1.9$$

with $g_{plc}$ clipped at a lower threshold of 0.1 and an upper threshold of 0.9. Other values in the range of 0 to 1 may be used as lower and upper thresholds.

In accordance with the foregoing specific example, at the end of a good segment (after synthesis of the output) the estimate of periodicity is calculated as explained above, and the energy of the long-term synthesis filter excitation is updated as $$E_m = \sum_{n=1}^{FRSZ}[uq(n)]^2$$

where $E_m$ is the updated energy of the long-term synthesis filter excitation, FRSZ is the number of samples per segment, and uq(n) is the scaled long-term excitation.

2. Processing of Extended Bad Segments

For extended bad segments, an embodiment of the present invention gradually reduces the regenerated signal. For example, in an embodiment where 5 ms frames are used, when 8 or more consecutive frames are bad (corresponding to 40 ms of speech), the regenerated signal is gradually reduced. For this purpose, the filter coefficients of the long-term synthesis filter are gradually scaled down and the random sequence is also gradually scaled down at the same time. This technique achieves two goals: (1) it gradually mutes the regenerated signal during extended bad segments, and (2) it gradually reduces the periodicity of the output speech during extended missing segments, thus making the output speech sound less buzzy. Buzzy-sounding speech is a common problem for packet loss concealment during extended periods of lost packets. This embodiment of the present invention helps to alleviate this problem.

A more specific example of the foregoing technique will now be described. In this specific example, at the end of processing a bad frame (for example, after synthesis of the decoder output signal), the energy of the long-term synthesis filter excitation and the long-term synthesis filter coefficients are scaled down when 8 or more consecutive segments are lost. The determination of the updated energy of the long-term synthesis filter excitation, $E_m$, and the filter coefficients of the long-term synthesis filter, $b_{m,i}$, can be expressed as follows:

$$E_m = \begin{cases} E_{m-1} & Nclf < 8 \\ (\beta_{Nclf})^2 E_{m-1} & Nclf \geq 8 \end{cases}$$

$$b_{m,i} = \begin{cases} b_{m-1,i} & Nclf < 8 \\ \beta_{Nclf}\, b_{m-1,i} & Nclf \geq 8 \end{cases}$$

where Nclf is the number of consecutive lost frames, $E_{m-1}$ is the energy of the long-term excitation for the previously-decoded frame, $b_{m-1,i}$ are the long-term synthesis filter coefficients for the previously-decoded frame, and the scaling, $\beta_{Nclf}$, is given by $$\beta_{Nclf} = \begin{cases} 1 - 0.02(Nclf - 7) & 8 \le Nclf \le 57 \\ 0 & Nclf > 57 \end{cases}.$$

3. Example Decoder Structure

Figure 3:
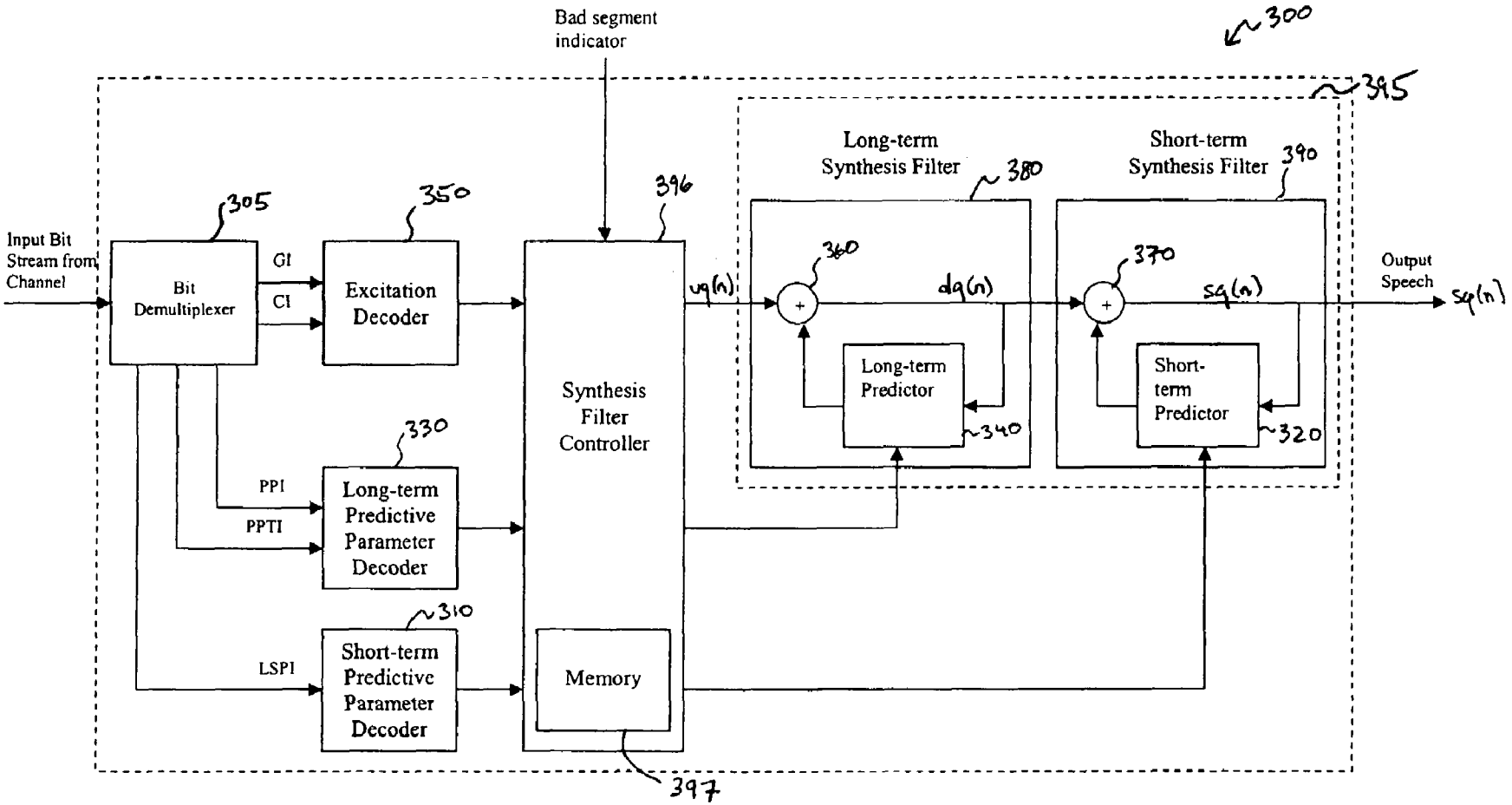
FIG. 3 is a block diagram of a predictive decoder that performs PLC and/or FEC in accordance with an embodiment of the present invention.

FIG. 3 depicts an example predictive speech decoder 300 that implements a method for PLC and/or FEC in accordance with the above-described methods. Although methods in accordance with the present invention may be implemented in a speech decoder, persons skilled in the art will readily appreciate that the invention is not so limited. For example, such methods may also be implemented in a stand-alone module that is used as part of a post-processing operation that occurs after speech decoding. Parameters necessary for performing the methods may be passed to the module from the speech decoder or may be derived by the module itself.

As shown in FIG. 3, speech decoder 300 includes a bit demultiplexer 305, an excitation decoder 350, a short-term predictive parameter decoder 310, a long-term predictive parameter decoder 330, a synthesis filter module 395, and a synthesis filter controller 396. Synthesis filter module 395 includes a long-term synthesis filter 380, which includes a long-term predictor 340 and an adder 360, and a short-term synthesis filter 390, which includes a short-term predictor 320 and an adder 370. With the exception of synthesis filter controller 396, the remaining elements of speech decoder 300 function in the same manner as corresponding like-named elements in conventional speech decoder 100 as described above in reference to FIG. 1.

As shown in FIG. 3, synthesis filter controller 396 is coupled to synthesis filter module 395. Synthesis filter controller 396 operates to control the operation of synthesis filter module 395 in the event that one or more bad segments of speech is received by speech decoder 300 in the manner described above with reference to the flowchart 200 of FIG. 2.

In particular, synthesis filter controller 396 determines whether a segment of encoded speech is bad. In an embodiment, an application external to speech decoder 300 determines whether a segment of speech is bad prior to receipt of the segment by decoder 300. For example, another application such as a channel decoder may perform an error detection algorithm to determine whether a frame of speech is bad. Similarly, another application such as a Voice over Internet Protocol (VoIP) application may determine that a packet has been lost and thus one or more corresponding frames of speech have been lost. A bad segment indicator is provided as an input from the other application to synthesis filter controller 396 to indicate to synthesis filter 296 that the segment is bad.

If the segment is not bad, then decoders 310, 330 and 350 decode the segment to provide the short-term predictive parameters, long-term predictive parameters, and scaled excitation signal uq(n) in the same manner as the like-named elements of conventional speech decoder 100 described above in reference to FIG. 1. When the segment is not bad, synthesis filter controller 396 uses these decoded values to control the operation of synthesis filter module 395. However, if the segment is bad, then synthesis filter controller 396 derives the scaled excitation signal by scaling a random sequence of samples and derives the long-term and short-term predictive parameters based on the parameters from a previously-decoded segment in the manner described above in reference to FIG. 2. In order to perform operations based on parameters associated with previously-decoded segments, synthesis filter controller 396 includes or otherwise has access to a suitable memory 397, as shown in FIG. 3.

In either case, once the short-term predictive parameters, long-term predictive parameters, and scaled excitation signal uq(n) have been determined for a segment, the scaled excitation signal uq(n) is filtered by long-term synthesis filter 380 under the control of the long-term predictive parameters to generate an output signal dq(n), which may be thought of as the short-term excitation signal. The signal dq(n) is then filtered by short-term synthesis filter 390 under the control of the short-term predictive parameters to generate an output signal sq(n), which is the synthesized speech, which may be for example the decoded speech.

It should be noted that although the embodiments described above with respect to FIGS. 2 and 3 discuss performing long-term synthesis filtering followed by short-term synthesis filtering, persons skilled in the art will readily appreciate that synthesized speech may also be obtained by performing short-term synthesis filtering before long-term synthesis filtering. Furthermore, a long-term synthesis filter and a short-term synthesis filter may be combined into a single filter. The present invention encompasses such alternative implementations.

4. Hardware and Software Implementations

Figure 4:
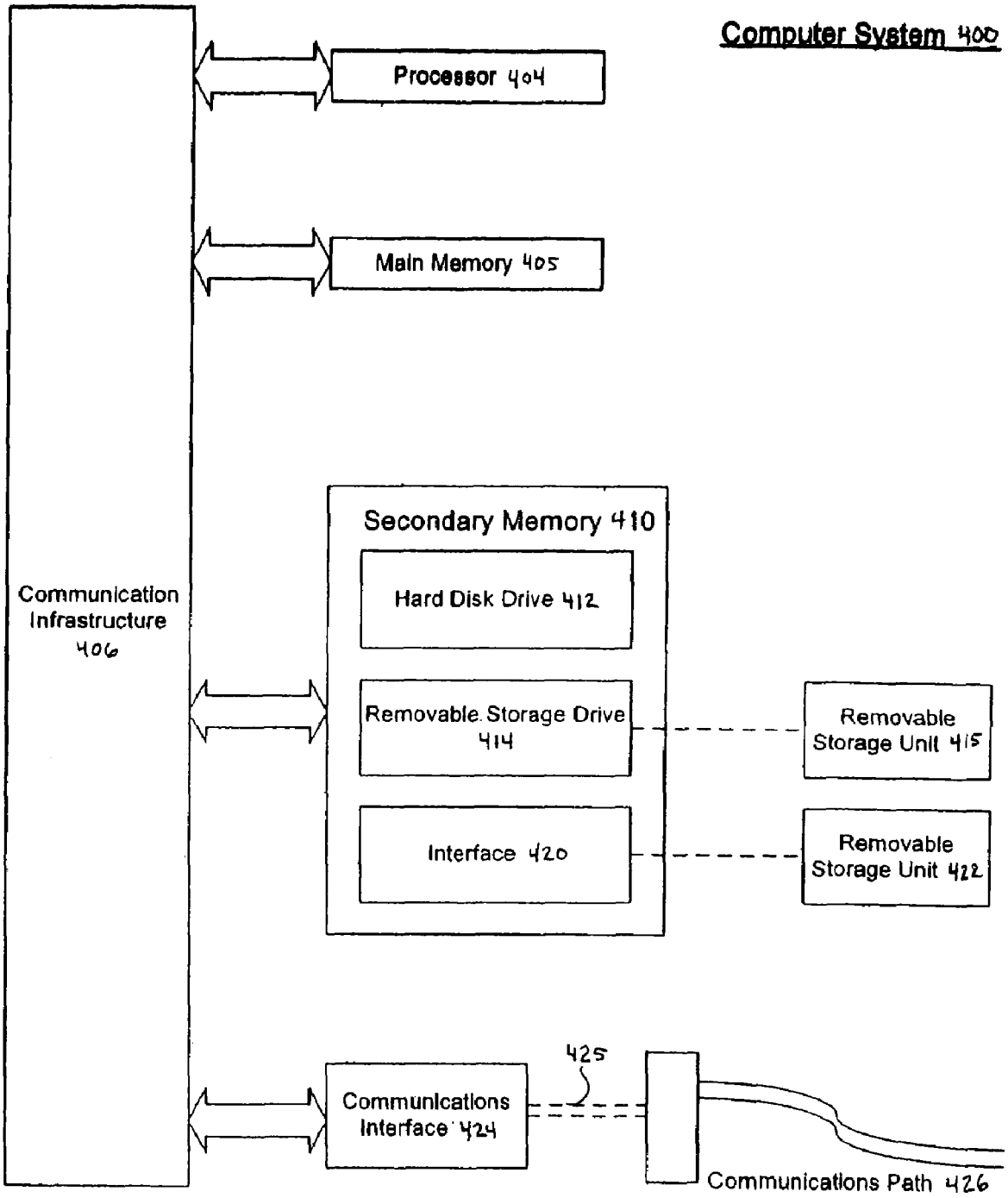
FIG. 4 is a block diagram of a computer system on which an embodiment of the present invention may operate.

The following description of a general purpose computer system is provided for completeness. The present invention can be implemented in hardware, or as a combination of software and hardware. Consequently, the invention may be implemented in the environment of a computer system or other processing system. An example of such a computer system 400 is shown in FIG. 4. In the present invention, all of the signal processing blocks depicted in FIG. 3, for example, can execute on one or more distinct computer systems 400, to implement the various methods of the present invention. The computer system 400 includes one or more processors, such as processor 404. Processor 404 can be a special purpose or a general purpose digital signal processor. The processor 404 is connected to a communication infrastructure 406 (for example, a bus or network). Various software implementations are described in terms of this exemplary computer system. After reading this description, it will become apparent to a person skilled in the art how to implement the invention using other computer systems and/or computer architectures.

Computer system 400 also includes a main memory 405, preferably random access memory (RAM), and may also include a secondary memory 410. The secondary memory 410 may include, for example, a hard disk drive 412 and/or a removable storage drive 414, representing a floppy disk drive, a magnetic tape drive, an optical disk drive, etc. The removable storage drive 414 reads from and/or writes to a removable storage unit 415 in a well known manner. Removable storage unit 415, represents a floppy disk, magnetic tape, optical disk, etc. which is read by and written to by removable storage drive 414. As will be appreciated, the removable storage unit 415 includes a computer usable storage medium having stored therein computer software and/or data.

In alternative implementations, secondary memory 410 may include other similar means for allowing computer programs or other instructions to be loaded into computer system 400. Such means may include, for example, a removable storage unit 422 and an interface 420. Examples of such means may include a program cartridge and cartridge interface (such as that found in video game devices), a removable memory chip (such as an EPROM, or PROM) and associated socket, and other removable storage units 422 and interfaces 420 which allow software and data to be transferred from the removable storage unit 422 to computer system 400.

Computer system 400 may also include a communications interface 424. Communications interface 424 allows software and data to be transferred between computer system 400 and external devices. Examples of communications interface 424 may include a modem, a network interface (such as an Ethernet card), a communications port, a PCMCIA slot and card, etc. Software and data transferred via communications interface 424 are in the form of signals 425 which may be electronic, electromagnetic, optical or other signals capable of being received by communications interface 424. These signals 425 are provided to communications interface 424 via a communications path 426. Communications path 426 carries signals 425 and may be implemented using wire or cable, fiber optics, a phone line, a cellular phone link, an RF link and other communications channels. Examples of signals that may be transferred over interface 424 include: signals and/or parameters to be coded and/or decoded such as speech and/or audio signals and bit stream representations of such signals; any signals/parameters resulting from the encoding and decoding of speech and/or audio signals; signals not related to speech and/or audio signals that are to be processed using the techniques described herein.

In this document, the terms "computer program medium" and "computer usable medium" are used to generally refer to media such as removable storage drive 414, a hard disk installed in hard disk drive 412, and signals 425. These computer program products are means for providing software to computer system 400.

Computer programs (also called computer control logic) are stored in main memory 405 and/or secondary memory 410. Also, decoded speech segments, filtered speech segments, filter parameters such as filter coefficients and gains, and so on, may all be stored in the above-mentioned memories. Computer programs may also be received via communications interface 424. Such computer programs, when executed, enable the computer system 400 to implement the present invention as discussed herein. In particular, the computer programs, when executed, enable the processor 404 to implement the processes of the present invention, such as the method illustrated in FIG. 2, for example. Accordingly, such computer programs represent controllers of the computer system 400. Where the invention is implemented using software, the software may be stored in a computer program product and loaded into computer system 400 using removable storage drive 414, hard drive 412 or communications interface 424.

In another embodiment, features of the invention are implemented primarily in hardware using, for example, hardware components such as application specific integrated circuits (ASICs) and gate arrays. Implementation of a hardware state machine so as to perform the functions described herein will also be apparent to persons skilled in the art.

C. Conclusion

While various embodiments of the present invention have been described above, it should be understood that they have been presented by way of example only, and not limitation. It will be understood by those skilled in the relevant art(s) that various changes in form and details may be made therein without departing from the spirit and scope of the invention as defined in the appended claims. For example, although the embodiments described above are described in reference to the decoding speech signals, the present invention is equally applicable to the decoding of audio signals generally. Accordingly, the breadth and scope of the present invention should not be limited by any of the above-described exemplary embodiments, but should be defined only in accordance with the following claims and their equivalents.

What is claimed is:

1. A method for decoding an encoded speech signal, comprising:

if a segment of the encoded speech signal is good, decoding the segment to derive an excitation signal, long-term predictive parameters and short-term predictive parameters;

if the segment is bad, scaling a random sequence of samples to derive the excitation signal and deriving the long-term predictive parameters and short-term predictive parameters based on parameters associated with a previously decoded segment, wherein scaling the random sequence comprises:

calculating a scaling factor; and applying the scaling factor to scale the random sequence relative to a level of previous long-term excitation;

wherein calculating the scaling factor comprises increasing the value of the scaling factor towards an upper limit with decreasing periodicity and decreasing the value of the scaling factor towards a lower limit with increasing periodicity;

filtering the excitation signal in a long-term synthesis filter under the control of the long-term predictive parameters, thereby generating a first output signal; and filtering the first output signal in a short-term synthesis filter under the control of the short-term predictive parameters, thereby generating a second output signal.

2. The method of claim 1, wherein the level of previous long-term excitation is measured in terms of signal energy.

3. The method of claim 1, wherein the level of previous long-term excitation is measured in terms of average signal amplitude.

4. The method of claim 1, wherein scaling the random sequence comprises scaling the random sequence such that the level of the random sequence approaches a level of previous long-term excitation for decreasing periodicity, and the level of the random sequence decreases as compared to the level of previous long-term excitation for increasing periodicity.

5. The method of claim 1, wherein scaling the random sequence comprises scaling the random sequence as a function of periodicity.

6. The method of claim 5, wherein scaling the random sequence as a function of periodicity comprises scaling the random sequence in accordance with a monotonic decreasing function.

7. The method of claim 1, wherein scaling the random sequence comprises multiplying a first factor that corresponds to a level of previous long-term excitation by a second factor that operates to reduce the level of previous long-term excitation with increasing periodicity.

8. The method of claim 1, wherein scaling the random sequence comprises:

using a measure of periodicity to control the scaling of the random sequence.

9. The method of claim 8, wherein using a measure of periodicity comprises using a measure of an instantaneous periodicity of a previously-decoded segment of the encoded speech signal.

10. The method of claim 8, wherein using a measure of periodicity comprises using a smoothed periodicity measure.

11. The method of claim 10, wherein using a smoothed periodicity measure comprises low pass filtering an instantaneous periodicity measure of a previously-decoded segment of the encoded speech signal.

12. The method of claim 11, wherein using a smoothed periodicity measure comprises calculating:

$$c_s(k)=\alpha\cdot c_s(k-1)+(1-\alpha)\cdot c(k),$$

wherein $c_s(k)$ is the smoothed periodicity measure, $c_s(k-1)$ is the smoothed periodicity measure of a previously-decoded segment of the encoded speech signal, c(k) is an instantaneous periodicity measure, and $\alpha$ is a predetermined factor that controls smoothing.

13. The method of claim 1, wherein deriving the long-term predictive parameters and short-term predictive parameters based on parameters associated with a previously-decoded segment comprises using long-term predictive parameters and short-term predictive parameters associated with the previously-decoded segment.

14. The method of claim 1, further comprising:

determining if a number of consecutively-received bad segments exceeds a predetermined threshold;

if the number of consecutively-received bad segments exceeds the predetermined threshold, gradually reducing the second output signal.

15. The method of claim 1, further comprising:

monitoring a number of consecutively-received bad segments; and gradually reducing a scaling factor used for scaling the random sequence in relation to the number of consecutively-received bad segments.

16. The method of claim 1, wherein the long-term predictive parameters include a long-term filter coefficient, the method further comprising:

monitoring a number of consecutively-received bad segments; and gradually reducing the long-term filter coefficient in relation to the number of consecutively-received bad segments.

17. The method of claim 1, wherein the long-term predictive parameters include a long-term filter coefficient, the method further comprising:

determining if a number of consecutively-received bad segments exceeds a predetermined threshold;

if the number of consecutively-received bad segments exceeds the predetermined threshold, gradually reducing a scaling factor used for scaling the random sequence in relation to the number of consecutively-received bad segments and gradually reducing the long-term filter coefficient in relation to the number of consecutively-received bad segments.

18. A method for decoding an encoded speech signal, comprising:

if a segment of the encoded speech signal is good, decoding the segment to derive an excitation signal and predictive parameters for controlling a synthesis filter;

if the segment is bad, scaling a random sequence of samples to derive the excitation signal, and deriving the predictive parameters based on parameters associated with a previously decoded segment, wherein scaling the random sequence comprises:

calculating a scaling factor; and applying the scaling factor to scale the random sequence relative to a level of previous long-term excitation;

wherein calculating the scaling factor comprises increasing the value of the scaling factor towards an upper limit with decreasing periodicity and decreasing the value of the scaling factor towards a lower limit with increasing periodicity; and filtering the excitation signal in a synthesis filter under the control of the predictive parameters.

19. A method for decoding an encoded speech signal, comprising:

if a segment of the encoded speech signal is good, decoding the segment to derive an excitation signal;

if the segment is bad, scaling a random sequence of samples to derive the excitation signal, wherein scaling the random sequence comprises:

calculating a scaling factor; and applying the scaling factor to scale the random sequence relative to a level of previous long-term excitation;

wherein calculating the scaling factor comprises increasing the value of the scaling factor towards an upper limit with decreasing periodicity and decreasing the value of the scaling factor towards a lower limit with increasing periodicity; and filtering the excitation signal in a synthesis filter under the control of predictive parameters.

20. A speech decoder, comprising:

a controller configured to derive an excitation signal, long-term predictive parameters and short-term predictive parameters;

a long-term synthesis filter that filters the excitation signal under the control of the long-term predictive parameters to generate a first output signal;

a short-term synthesis filter that filters the first output signal under the control of the short-term predictive parameters to generate a second output signal;

wherein the controller is configured (a) to derive the excitation signal, long-term predictive parameters and short-term predictive parameters from decoded information pertaining to a segment of an encoded speech signal if the segment is good, and (b) to derive the long-term predictive parameters and short-term predictive parameters based on parameters associated with a previously decoded segment and to derive the excitation signal by scaling a random sequence of samples if the segment is bad, wherein scaling the random sequence comprises:

calculating a scaling factor; and applying the scaling factor to scale the random sequence relative to a level of previous long-term excitation;

wherein calculating the scaling factor comprises increasing the value of the scaling factor towards an upper limit with decreasing periodicity and decreasing the value of the scaling factor towards a lower limit with increasing periodicity.

21. The speech decoder of claim 20, wherein the level of previous long-term excitation is measured in terms of signal energy.

22. The speech decoder of claim 20, wherein the level of previous long-term excitation is measured in terms of average signal amplitude.

23. The speech decoder of claim 20, wherein the controller is configured to scale the random sequence such that the level of the random sequence approaches a level of a previous long-term excitation for decreasing periodicity, and the level of the random sequence decreases as compared to that of the level of previous long-term excitation for increasing periodicity.

24. The speech decoder of claim 20, wherein the controller is configured to scale the random sequence as a function of periodicity.

25. The speech decoder of claim 24, wherein the controller is configured to scale the random sequence in accordance with a monotonic decreasing function.

26. The speech decoder of claim 20, wherein the controller is configured to scale the random sequence by multiplying a first factor that corresponds to a level of previous long-term excitation by a second factor that operates to reduce the level of previous long-term excitation with increasing periodicity.

27. The speech decoder of claim 20, wherein the controller is configured to use a measure of periodicity to control the scaling of the random sequence.

28. The speech decoder of claim 27, wherein the controller is configured to use a measure of an instantaneous periodicity of a previously-decoded segment of the encoded speech signal to control the scaling of the random sequence.

29. The speech decoder of claim 27, wherein the controller is configured to use a smoothed periodicity measure to control the scaling of the random sequence.

30. The speech decoder of claim 29, wherein the controller is further configured to low pass filter an instantaneous periodicity measure of a previously-decoded segment of the encoded speech signal to derive the smoothed periodicity measure.

31. The speech decoder of claim 29, wherein the controller is further configured to calculate the smoothed periodicity measure in accordance with:

$$c_s(k)=\alpha\cdot c_s(k-1)+(1-\alpha)\cdot c(k),$$

wherein $c_s(k)$ is the smoothed periodicity measure, $c_s(k-1)$ is the smoothed periodicity measure of a previously-decoded segment of the encoded speech signal, c(k) is an instantaneous periodicity measure, and $\alpha$ is a predetermined factor that controls smoothing.

32. The speech decoder of claim 20, wherein the controller is configured to use the long-term predictive parameters and short-term predictive parameters associated with a previously decoded segment if the segment is bad.

33. The speech decoder of claim 20, wherein the controller is further configured to gradually reduce the second output signal based on whether a number of consecutively-received bad segments exceeds a predetermined threshold.

34. The speech decoder of claim 20, wherein the controller is further configured to monitor a number of consecutively-received bad segments and to gradually reduce a scaling factor used for scaling the random sequence in relation to the number of consecutively-received bad segments.

35. The speech decoder of claim 20, wherein the controller is further configured to monitor a number of consecutively-received bad segments and to gradually reduce a long-term filter coefficient in relation to the number of consecutively-received bad segments.

36. The speech decoder of claim 20, wherein the controller is further configured to determine if a number of consecutively-received bad segments exceeds a predetermined threshold, and, if the number of consecutively-received bad segments exceeds the predetermined threshold, to gradually reduce a scaling factor used for scaling the random sequence in relation to the number of consecutively-received bad segments and to gradually reduce a long-term filter coefficient in relation to the number of consecutively-received bad segments.

37. A speech decoder, comprising:

a controller configured to derive an excitation signal and predictive parameters; and a synthesis filter that filters the excitation signal under the control of the predictive parameters;

wherein the controller is configured (a) to derive the excitation signal, long-term predictive parameters and short-term predictive parameters from decoded information pertaining to a segment of an encoded speech signal if the segment is good, and (b) to derive the long-term predictive parameters and short-term predictive parameters based on parameters associated with a previously decoded segment and to derive the excitation signal by scaling a random sequence of samples if the segment is bad, wherein scaling the random sequence comprises:

calculating a scaling factor; and applying the scaling factor to scale the random sequence relative to a level of previous long-term excitation;

wherein calculating the scaling factor comprises increasing the value of the scaling factor towards an upper limit with decreasing periodicity and decreasing the value of the scaling factor towards a lower limit with increasing periodicity.

38. A speech decoder, comprising:

a controller that derives an excitation signal; and a synthesis filter that filters the excitation signal under the control of predictive parameters;

wherein the controller is configured to derive the excitation signal from decoded information pertaining to a segment of an encoded speech signal if the segment is good and to derive the excitation signal by scaling a random sequence of samples if the segment is bad, wherein scaling the random sequence comprises:

calculating a scaling factor; and applying the scaling factor to scale the random sequence relative to a level of previous long-term excitation;

wherein calculating the scaling factor comprises increasing the value of the scaling factor towards an upper limit with decreasing periodicity and decreasing the value of the scaling factor towards a lower limit with increasing periodicity.

39. A method for processing a speech signal, comprising:

if a segment of the speech signal is good, using decoded information associated with the segment to derive an excitation signal, long-term predictive parameters and short-term predictive parameters if the segment is bad, scaling a random sequence of samples to derive the excitation signal and deriving the long-term predictive parameters and short-term predictive parameters based on parameters associated with a previously-processed segment of the speech signal, wherein scaling the random sequence comprises:

calculating a scaling factor; and applying the scaling factor to scale the random sequence relative to a level of previous long-term excitation;

wherein calculating the scaling factor comprises increasing the value of the scaling factor towards an upper limit with decreasing periodicity and decreasing the value of the scaling factor towards a lower limit with increasing periodicity;

filtering the excitation signal in a long-term synthesis filter under the control of the long-term predictive parameters, thereby generating a first output signal; and filtering the first output signal in a short-term synthesis filter under the control of the short-term predictive parameters, thereby generating a second output signal.

40. A method for processing a speech signal, comprising:

if a segment of the speech signal is good, using decoded information associated with the segment to derive an excitation signal and predictive parameters for controlling a synthesis filter;

if the segment is bad, scaling a random sequence of samples to derive the excitation signal, and deriving the predictive parameters based on parameters associated with a previously-processed segment, wherein scaling the random sequence comprises:

calculating a scaling factor; and applying the scaling factor to scale the random sequence relative to a level of previous long-term excitation;

wherein calculating the scaling factor comprises increasing the value of the scaling factor towards an upper limit with decreasing periodicity and decreasing the value of the scaling factor towards a lower limit with increasing periodicity; and filtering the excitation signal in a synthesis filter under the control of the predictive parameters.

41. A method for processing a speech signal, comprising:

if a segment of the speech signal is good, using decoded information associated with the segment to derive an excitation signal;

if the segment is bad, scaling a random sequence of samples to derive the excitation signal, wherein scaling the random sequence comprises:

calculating a scaling factor; and applying the scaling factor to scale the random sequence relative to a level of previous long-term excitation;

wherein calculating the scaling factor comprises increasing the value of the scaling factor towards an upper limit with decreasing periodicity and decreasing the value of the scaling factor towards a lower limit with increasing periodicity; and filtering the excitation signal in a synthesis filter under the control of predictive parameters.

* * * * *